US005265851A

United States Patent [19]

Beuret et al.

[11] Patent Number: 5,265,851

[45] Date of Patent: Nov. 30, 1993

[54] INSTALLATION FOR THE HEAT TREATMENT OF SUCCESSIVE BATCHES

[75] Inventors: Pierre Beuret; Jacques Beuret, both of Porrentruy, Switzerland

[73] Assignee: Codere SA, Porrentruy, Switzerland

[21] Appl. No.: 908,994

[22] Filed: Jul. 6, 1992

[30] Foreign Application Priority Data

Sep. 19, 1991 [CH] Switzerland ..... 2782/91

[51] Int. Cl.[5] ..... C21D 1/00

[52] U.S. Cl. ..... 266/262; 266/249; 266/143

[58] Field of Search ..... 266/262, 165, 256, 249, 266/143, 255

[56] References Cited

U.S. PATENT DOCUMENTS

| | | | |
|---|---|---|---|
| 4,415,145 | 11/1983 | Herdieckerhoff | 266/165 |
| 4,502,671 | 3/1985 | Omura | 266/256 |
| 4,846,675 | 7/1989 | Soliman | 266/256 |

*Primary Examiner*—Scott Kastler
*Attorney, Agent, or Firm*—Oliff & Berridge

[57] ABSTRACT

The loading car (25) transfers the batch and deposits it on the plug (10) of the furnace (1).

The batch is introduced into the furnace (1) and the latter is closed by means of the lift (12) which is lowered after the treatment to an intermediate position, from which moment the furnace (1 ) can be displaced horizontally, the lower belt (4) pushing the grid at the bottom of the batch over the cover (17) and the platform (22) of the lift (18) being in the upper position. The cover (17) ensures the imperviousness of the furnace opening to the gases protecting the batch.

This lift allows the batch to be introduced into the hardening vat then brought back into a drain position and deposited on the unloading car (38) which moves along the track (36, 37).

15 Claims, 9 Drawing Sheets

INSTALLATION FOR THE HEAT TREATMENT OF SUCCESSIVE BATCHES

BACKGROUND OF THE INVENTION

There already exist treatment installations comprising one or several furnaces or a plurality of vats and means for successively transferring a batch from a loading point into the furnace then into the vat and then for extracting this batch from the vat and bringing it to an exit point. We cite in particular the European patent application no. 0 296 102, published on 21 Dec. 1988.

The Swiss patent CH-478 918 also describes an installation of this type. In this latter, the bell is suspended inside the furnace by suspension means capable of making it turn about its axis when the lift is in the upper position, so that the batch can be placed on projecting supports which are integral with the inner wall of the bell.

This prior art installation allows the batch to be transferred from the lift to the furnace and then from the latter to the hardening vat, but it is a tricky operation to keep the batch secured to the bell and moreover, when the furnace is displaced from the loading position to the position for transfer into the vat, the bottom of the furnace is open and therefore the batch is subject to the risk of oxydation. Another disadvantage of this prior art installation is that the means for suspending the bell prevent a gas circulation turbine from being placed at the most favourable location, i.e. at the top of the furnace in the axis of the bell.

SUMMARY OF THE INVENTION

The aim of this invention is to design an installation of the type mentioned which is simpler than the prior art installations, capable of being manually operated whilst guaranteeing the movement of the batch between the various elements of the installation, thereby eliminating the risks to the treated parts, notably the risk of contact with the air, and therefore of oxydation.

In this aim, the subject of this invention is an installation for the heat treatment of successive batches, comprising an open-bottom vertically disposed furnace in an upper position, a vat equipped with a lift and placed in a lower position, a horizontal access track mounted at the level of the vat bottom and fitted with loading means, and a loading lift disposed at the side of the vat to lift a batch loaded onto the lift by the loading means into the furnace, this latter being horizontally mobile between a position above the loading lift and a position above the vat, characterized by a sliding plane placed at the level of the furnace bottom allowing a batch supported by the loading lift at that level to be shifted on said plane, by displacing said furnace.

BRIEF DESCRIPTION OF THE DRAWINGS

Several embodiments of the installation of the invention will be described below by way of example, with reference to the drawings, in which.

DETAILED DESCRIPTION OF THE PREFERRED EMBODIMENTS

Figure 1:
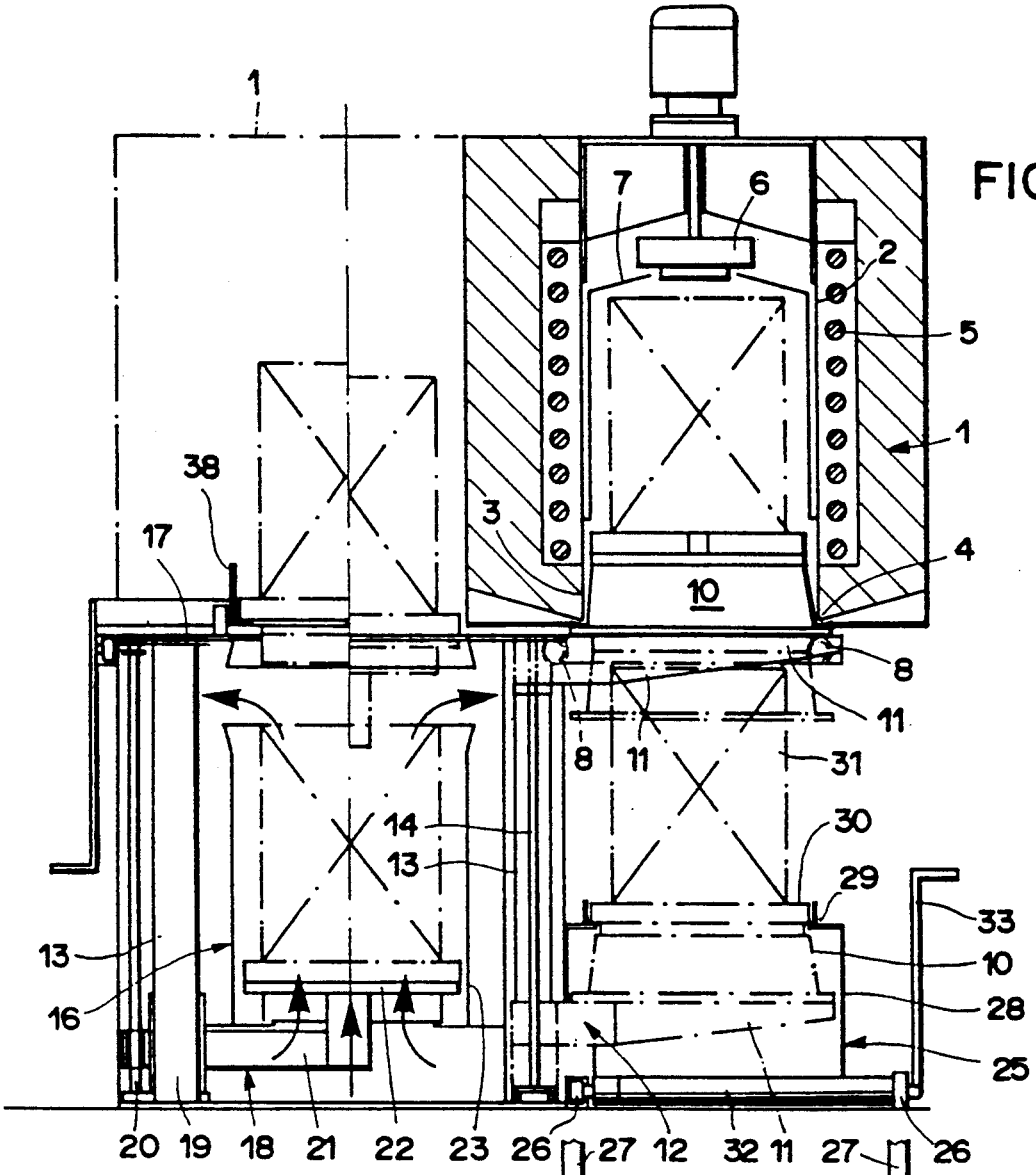
FIG. 1 is a diagrammatic elevation seen in the direction of the parallel loading and unloading tracks.

The installation shown in the drawing is a simple installation comprising only one furnace and one vat, a hardening vat, for example. It is an installation allowing various treatments such as austenitization, hardening, accelerated hardening, carbonitriding, nitration, annealing and tempering.

Figure 4:
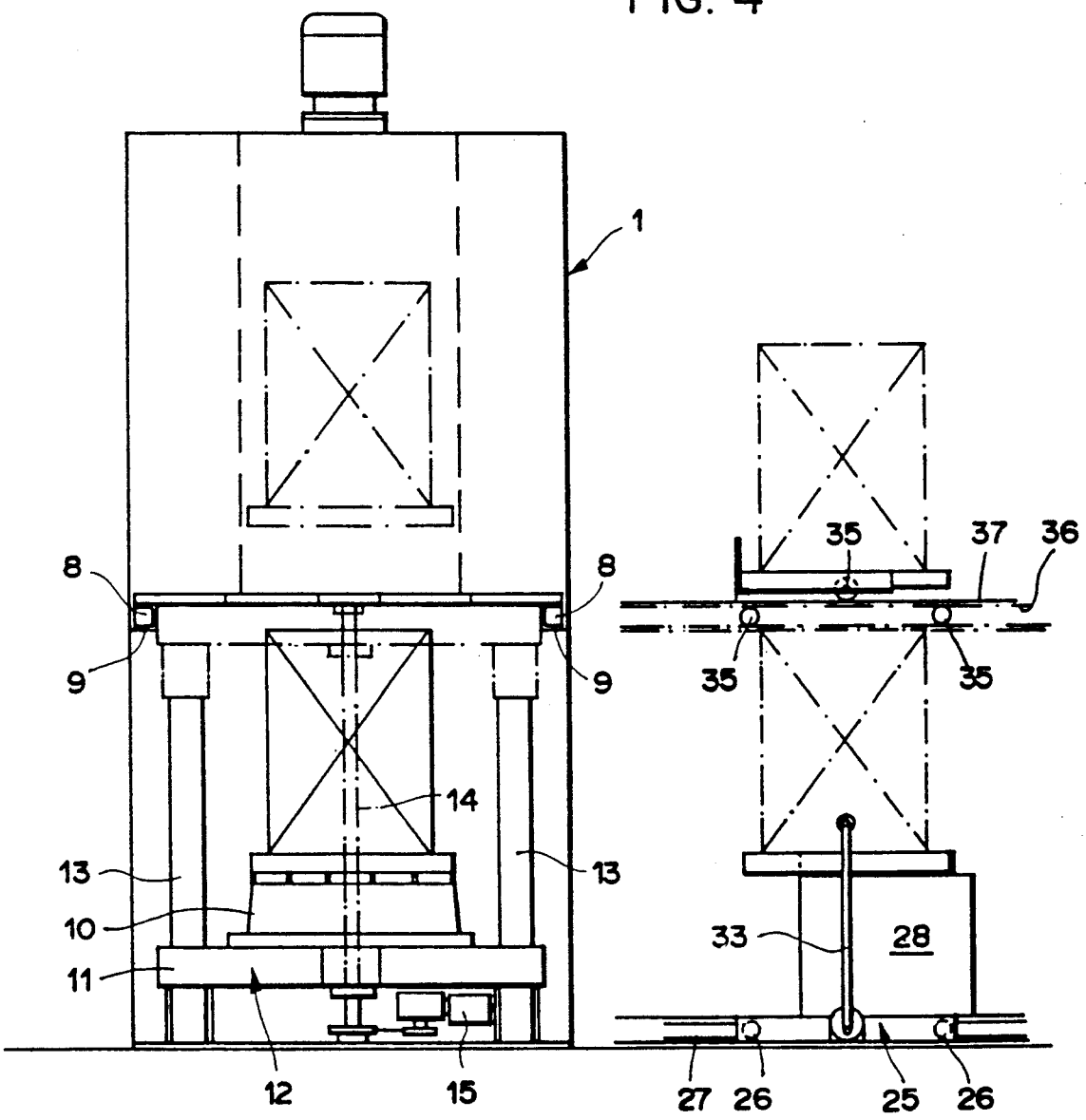
FIG. 4 is a diagrammatic elevation in a direction perpendicular to the loading and unloading tracks.

The installation of FIG. 1 shows in the first instance a furnace 1 of the removable-cover 2 type, this latter having at its base an opening 3 restricted by a belt 4, whose purpose will be explained below. Heating elements 5, a turbine 6 and a double shell 7 ensure the homogeneity of the rates of the treatment gases in the batch by forced circulation inside and around the bell 2. The furnace 1 is mobile from the right to the left, and from the left to the right along the plane of the drawing of FIG. 1. To this end, it is borne by rollers 8, which roll on a track designated by 9 in FIG. 4.

When situated in the position in FIG. 1, the furnace 1 can be closed by means of a plug or support 10 which is supported by the platform 11 of a lift 12, guided by two columns 13 (see FIG. 4) and driven by a screw 14, actioned by a motor 15. The motor control 15 thus allows the furnace 1 to be hermetically closed. These conditions allow the temperature of the batch to be increased rapidly by means of convection and radiation of the heat energy given off by the heating elements and thanks to the turbine for the forced circulation of the treatment gases. The advantage of this solution is that it ensures heat treatment of great precision with variations in temperature in the whole of the batch not exceeding $\pm 5°$ C.

The same can be said for the homogenity of the treatment gas rates in the charge by means of forced circulation through the double shell.

Figure 2:
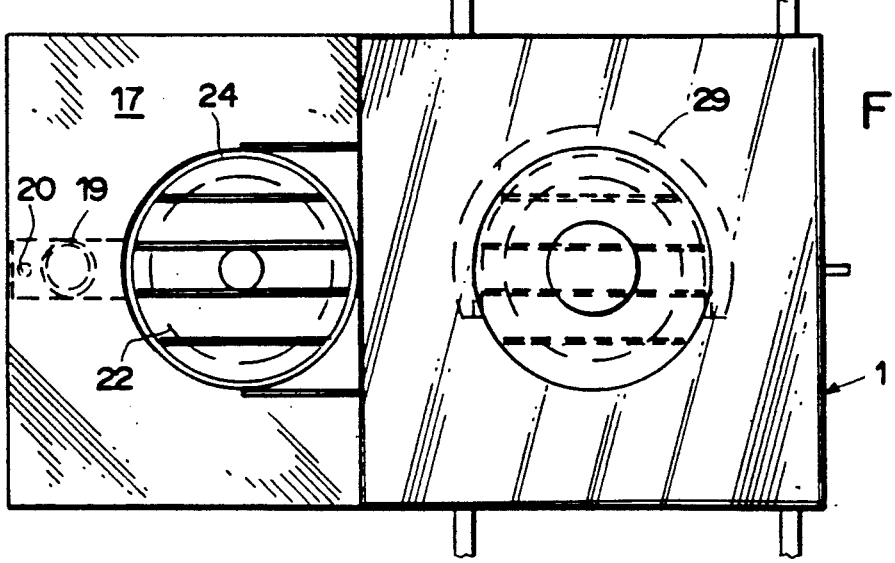
FIG. 2 is a top-plan diagrammatic view of the furnace and the vat of the installation of FIG. 1.
Figure 3:
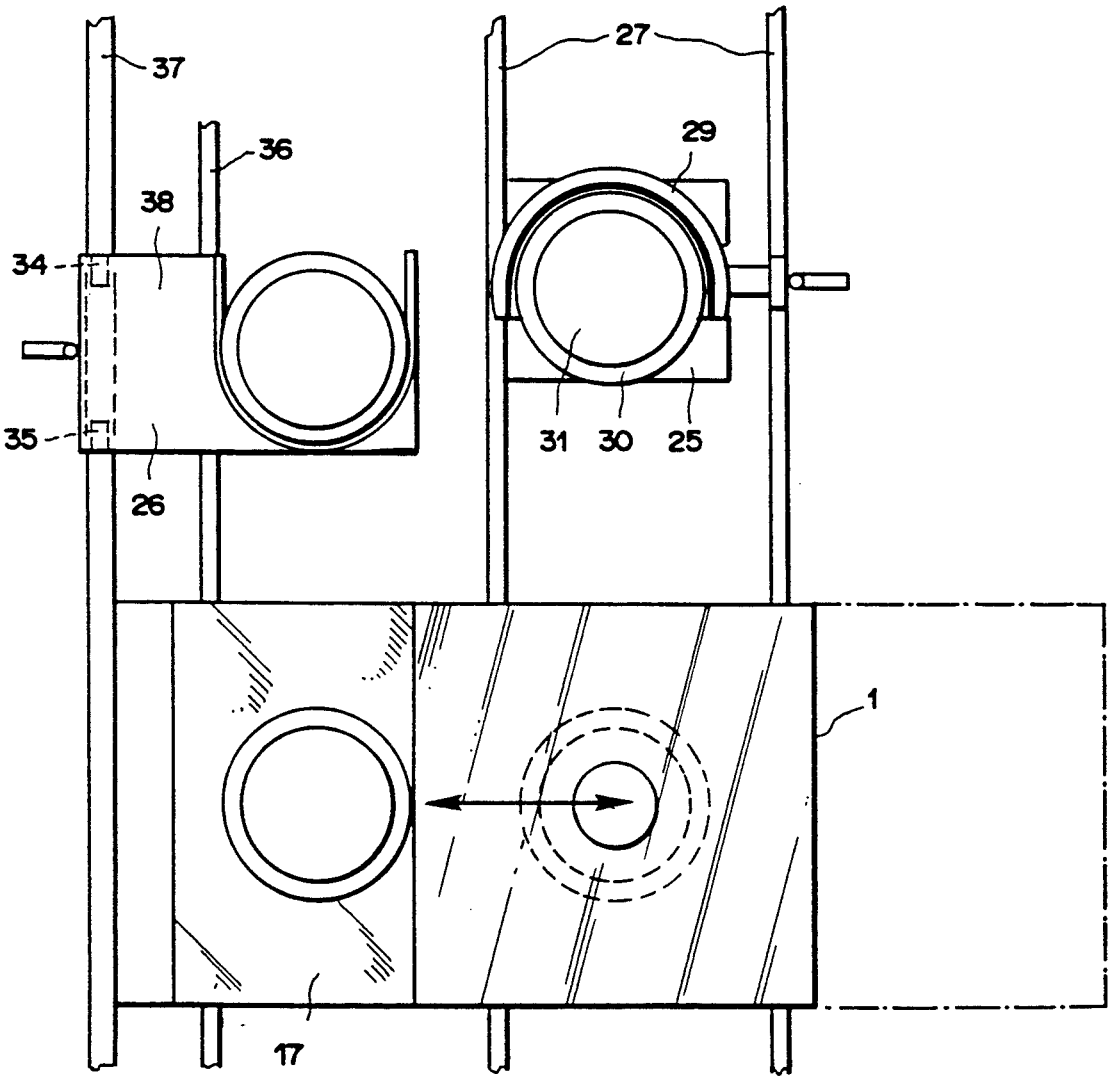
FIG. 3 is also a top-plan view showing the tracks and the loading and unloading cars.

When displaced to the left in FIG. 1, the furnace 1 is located above a hardening vat 16, of rectangular shape in plane, closed by a lid 17 and which contains a lift 18 comprised of a vertical guide column 19, a drive screw 20, a support arm 21 and a platform 22. Placed inside the vat are guide plates 23 forming the boundary of a channel allowing a homogenous flow of cooling liquid through the batch by means of circulators or agitating pumps. As can be seen in FIG. 2, the cover 17 is equipped with an opening 24 through which the platform 22 of the lift 18 can pass.

To transport the batch there are two cars, a loading car 25 and an unloading car 38. Car 25 moves on rollers 26 on a loading track constituted by two parallel rails 27 (FIG. 2), said track being located at the level of the vat bottom, beside the latter. It comprises a receptacle 28 and, in its upper part, a semi-circular support 29 for receiving a base grid 30 of a batch 31 comprised of parts in bulk in stacked baskets. An eccentric device 32, controlled by a lever 33, allows the receptacle 28 to be lowered or raised slightly in relation to the frame on which the rollers 26 pivot, so that a batch transported by the loading car over the plane inside surface of the plug 10 situated on the platform 11 brought into the lower position, can be deposited. Once this transfer operation is complete, it will be understood that the loading car 25 can be emptied and the lift 12 can be driven so as to place the batch 31 in the furnace, closing the furnace at the same time by means of the plug 10. The receptacle 28 and the car 25 can also be seen in FIG. 4, which shows the movement of the lever 33 allowing the batch to be transferred from the car 25 to the platform 11 of the loading lift.

Figure 5:
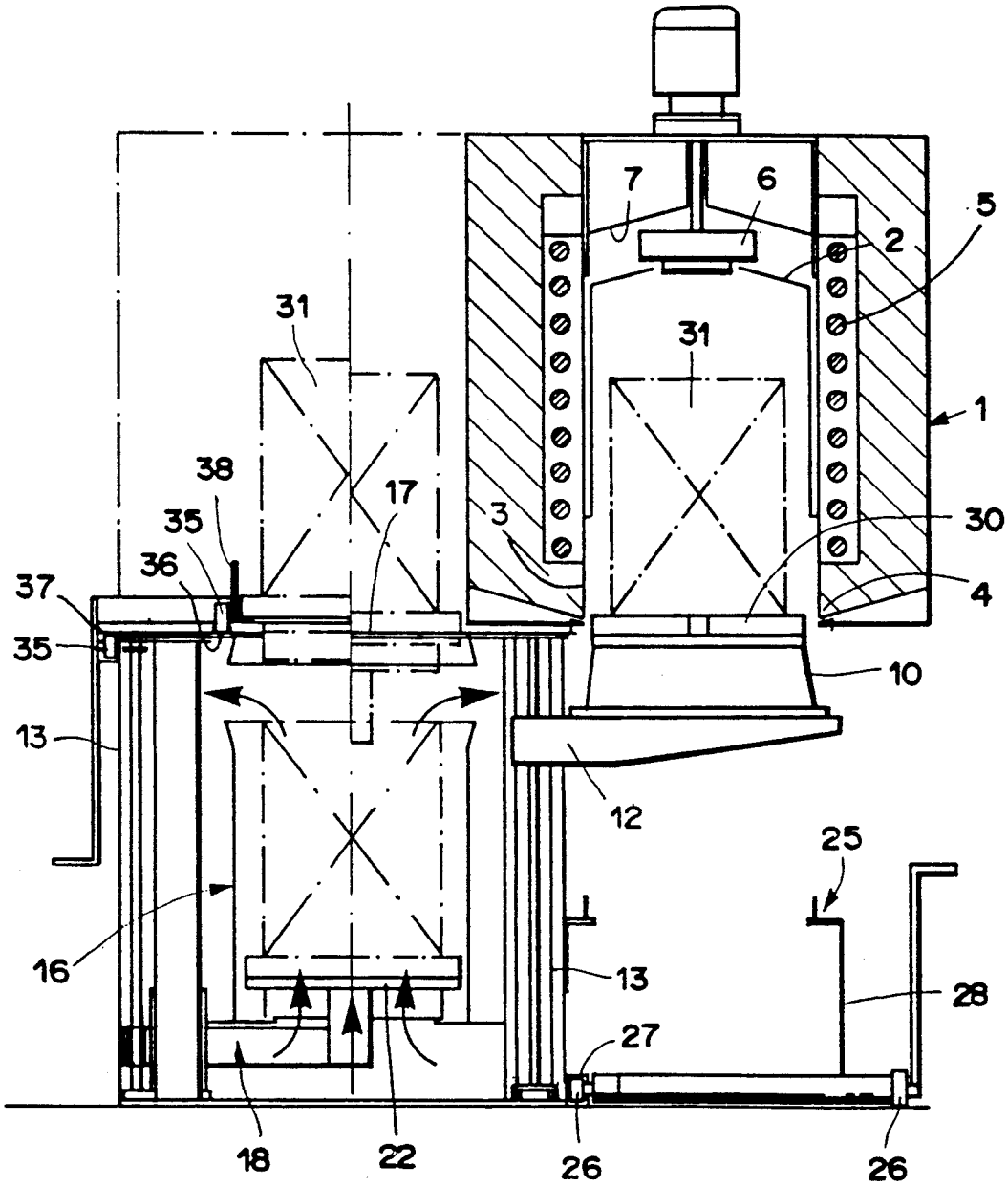
FIG. 5 is a similar figure in elevation to FIG. 1, showing the loading lift in an intermediate position.

FIG. 5 shows the operation for transferring the batch after high-temperature heat treatment in a controlled atmosphere. The lift 12 is operated so as to come into an intermediate position between the position where the furnace is closed in FIG. 1, and the lower loading position previously described. In this intermediate position, the plug 10 is extracted from the bell of the furnace and its flat upper surface is flush with the upper plane of the cover 17 of vat 16. The furnace is then displaced from right to left as in FIG. 5, the rollers 8 rolling on the rails 9, so that the bottom belt 4 pushes the base grid 30 over the inner surface of the plug 10 and slides the grid until it fits over the cover 17. The furnace is displaced until the grid 30 is positioned over the upper face of the platform 22 of the lift 18, which has been brought into a position where this upper surface is also located flush with surface 17. Thus, the batch is brought directly over the hardening vat whilst still remaining confined inside the bell of the furnace and thus protected from the atmosphere outside. All that is to be done now is to control the lift 18 so that the batch is lowered into the vat, then bring back the furnace to its initial position and reclose it by means of the lift 12 and the plug 10. This part of the installation is now ready to be reloaded using the car 25 and the lift 12.

Once the hardening operation is completed the lift 18 is operated again to bring the batch into a position for draining, shown by 31' in FIG. 5. The unloading car, which also comprises a semi-circular base and which is carried by three rollers 35 mounted on the two rails 36 and 37, is then brought into the position for unloading. By slightly lowering the platform of the lift 18, the batch 31 comes to rest on the base of the car 38. This latter can be moved off to the unloading point once the lift 18 has been lowered into the vat.

The batch is then brought via manual or motorized transfer to a washing machine or the next treatment unit, or an exit ramp.

It will be understood that by using only two parallel transport tracks, one for loading and one for unloading, one can make provision along this pair of tracks for a series of installations each with a furnace, a vat and a loading lift. The arrangement of these elements is described below.

Figure 8:
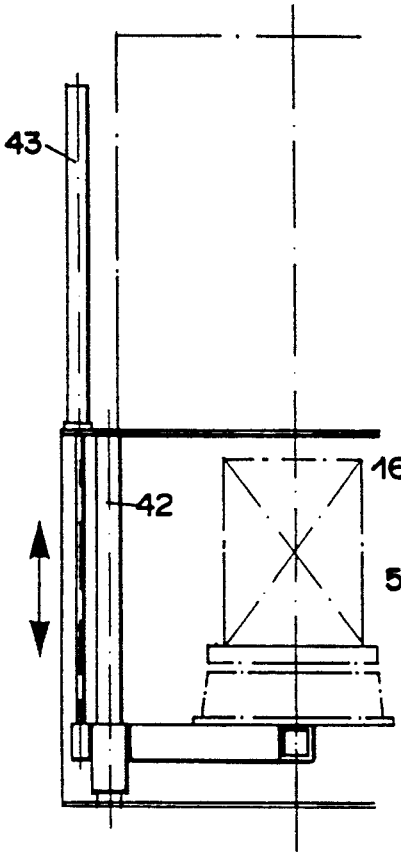
FIG. 8, is an elevation in the direction of the arrow A in FIG. 7, FIG. 9. is a diagrammatic view similar to that of FIG. 1, showing a third embodiment.
Figure 6:
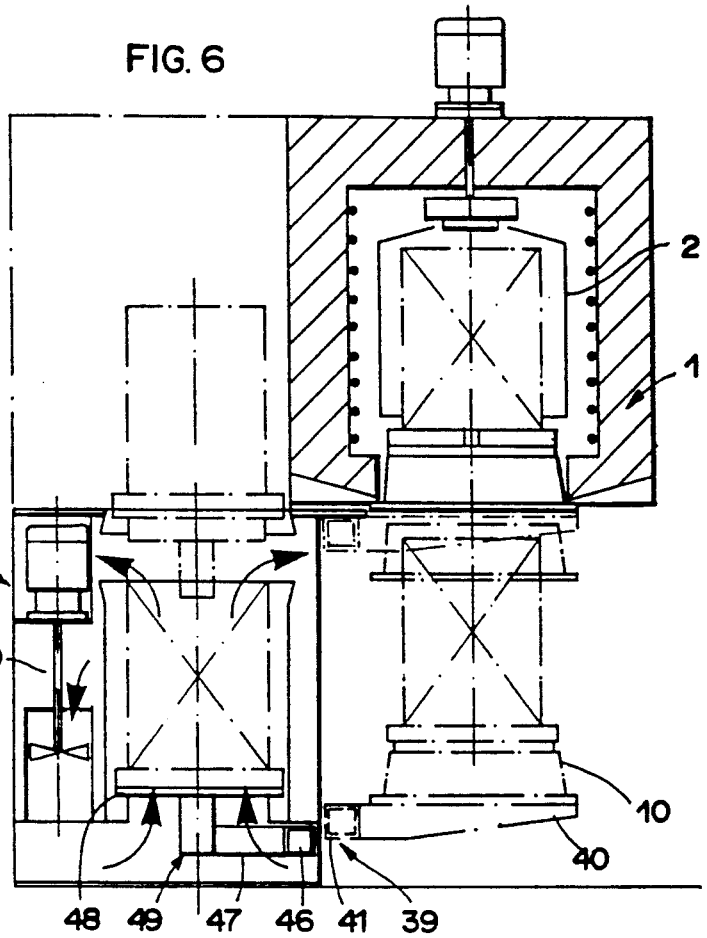
FIG. 6 is a similar view to that of FIG. 1 of a second embodiment of the installation of the invention.
Figure 7:
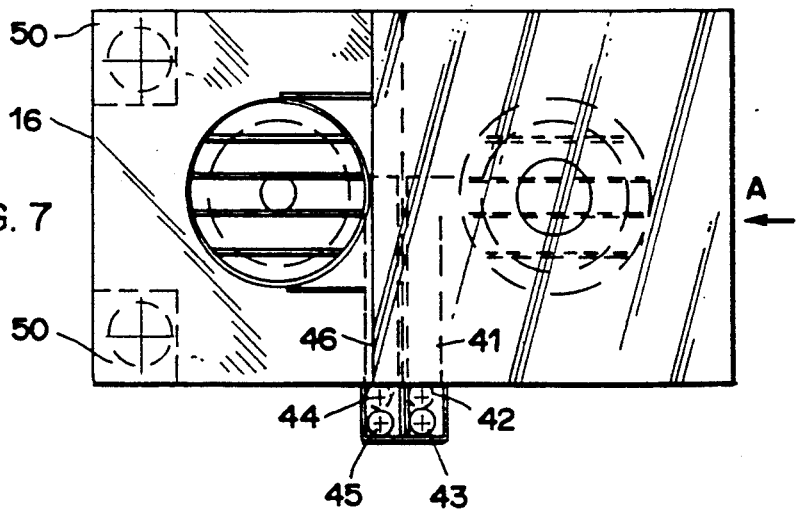
FIG. 7 is a top-plan view of this second embodiment.

FIGS. 6, 7 and 8 show a second embodiment in which the vat and the furnace are disposed in the same way as in the first embodiment, but the lifts of the vat and the furnace are disposed in a slightly different way so as to achieve better use of the available space.

There is therefore a furnace 1 with a bell 2 and a hardening vat 16. This latter is disposed in a lower, fixed position, whilst the furnace 1 is placed in an upper position and is laterally mobile so that it can be brought alternately above the vat 16 or above a loading lift designated here by 39. As in the first embodiment, the lift 39 carries the plug 10 of the furnace. It comprises a horizontal arm 40 fixed to the end of a perpendicular arm 41 which is itself guided overhangingly by a column 42 and driven vertically by a jack 43. FIG. 8 shows the vertical disposition of the guide column 42 and the jack 43. A similar column 44 and a jack 45 are disposed immediately to the side of elements 42 and 43, but inside the enclosure of the vat 16. The jack 45 controls an arm 46, fixed to a transverse arm 47 which supports a platform 48 similar to the platform 22. 44, 45, 46, 47 and 48 together constitute a lift 49 placed inside the vat 16 in the same way as the lift 22.

Also shown in FIG. 6 are the means 50 ensuring the circulation of the hardening liquid inside the vat 16. These two circulators 50 are placed in the outer angles of the vat.

Figure 9:
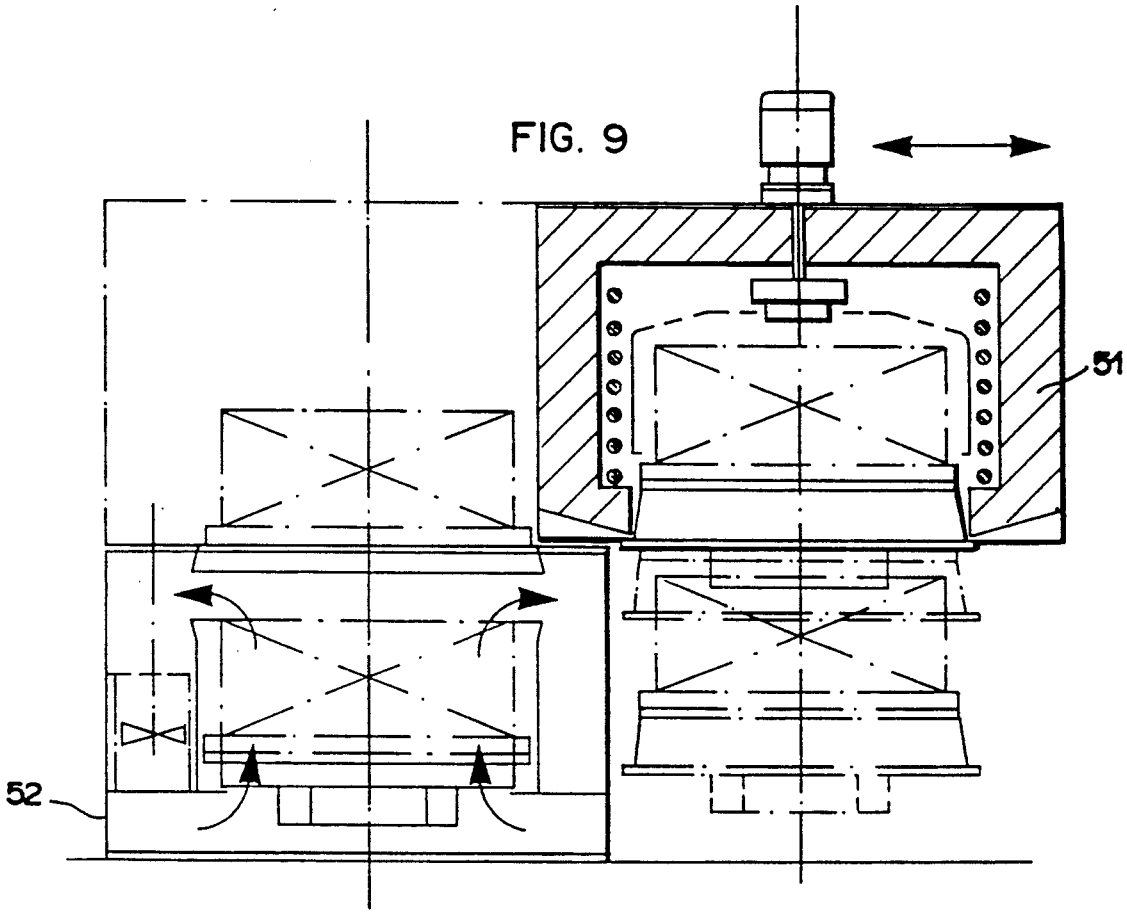
Figure 10:
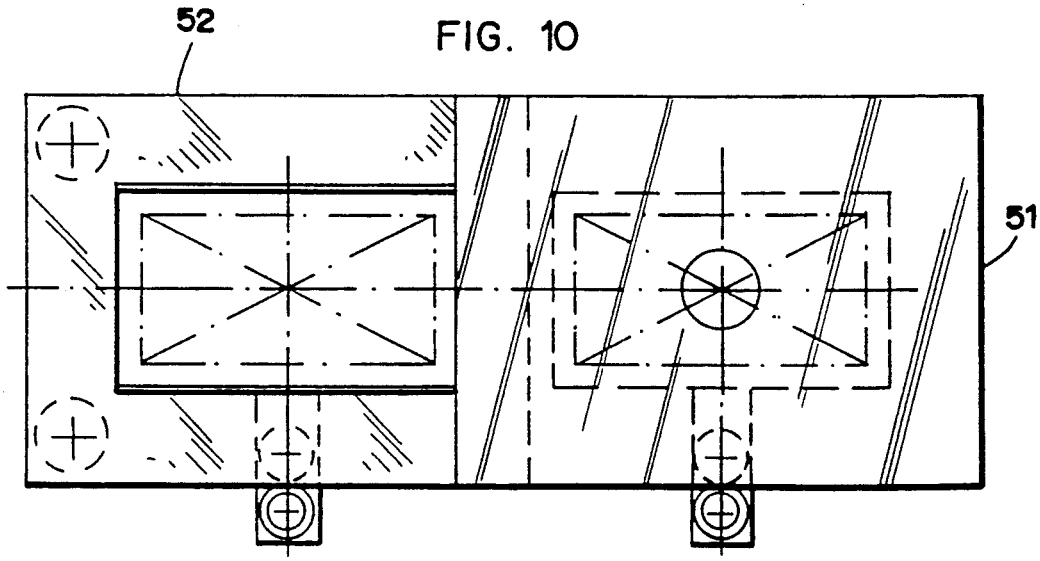
FIG. 10 is the same top-plan view as that of FIGS. 2 and 7, showing the third embodiment.

FIGS. 9 and 10 show a third embodiment of an installation according to the invention, and constructed with a rectangular-shaped furnace and a vat which is also rectangular-shaped. Moreover, the furnace 51 is of a similar construction to the furnace 1, whilst the vat 52 comprises elements similar to those of vat 16.

Figure 11:
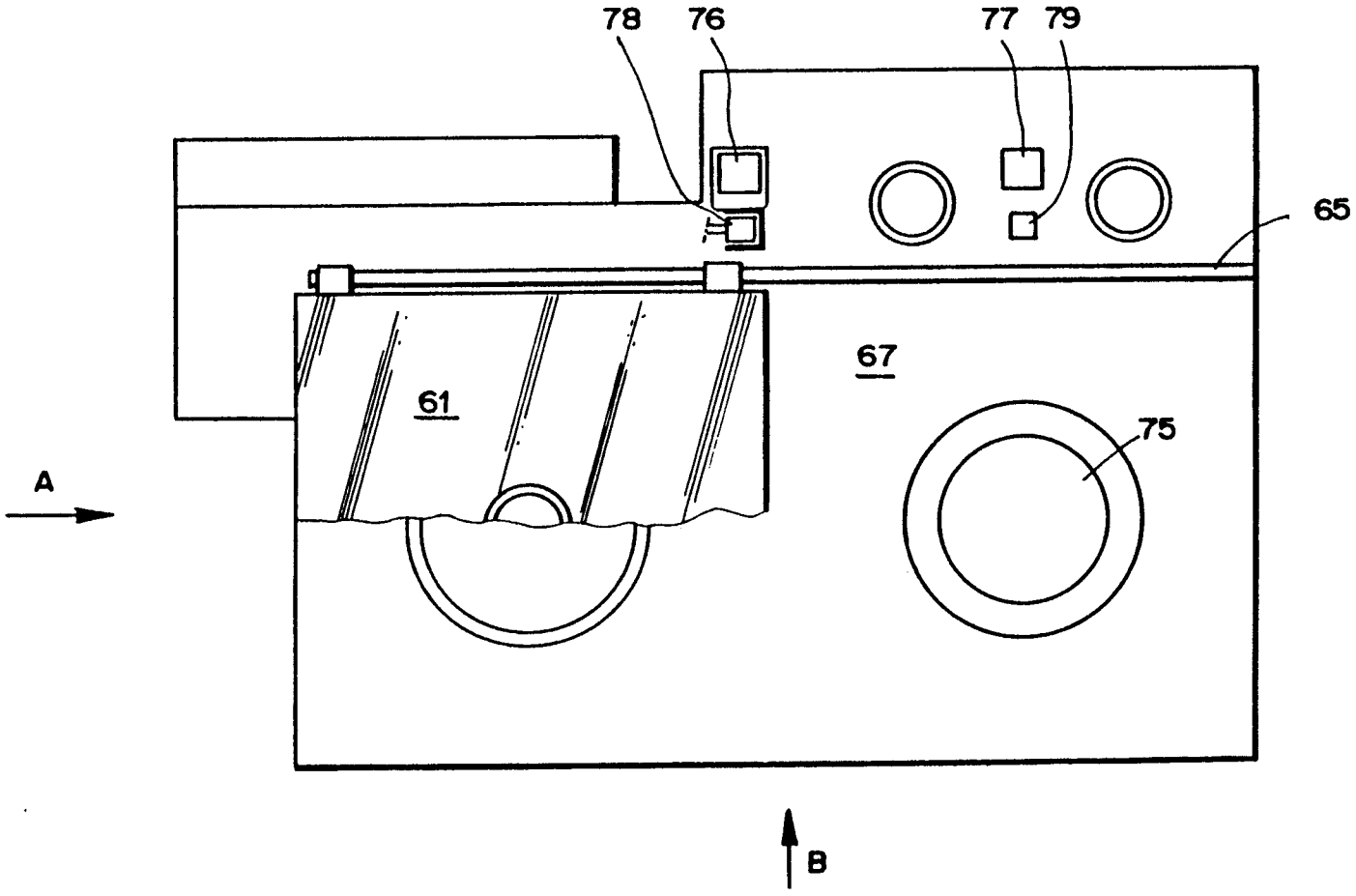
FIGS. 11, 12 and 13 show in top-plan view, in elevation in the direction of arrow A and in elevation/section in the direction of arrow B respectively, one embodiment provided with an improvement.
Figure 12:
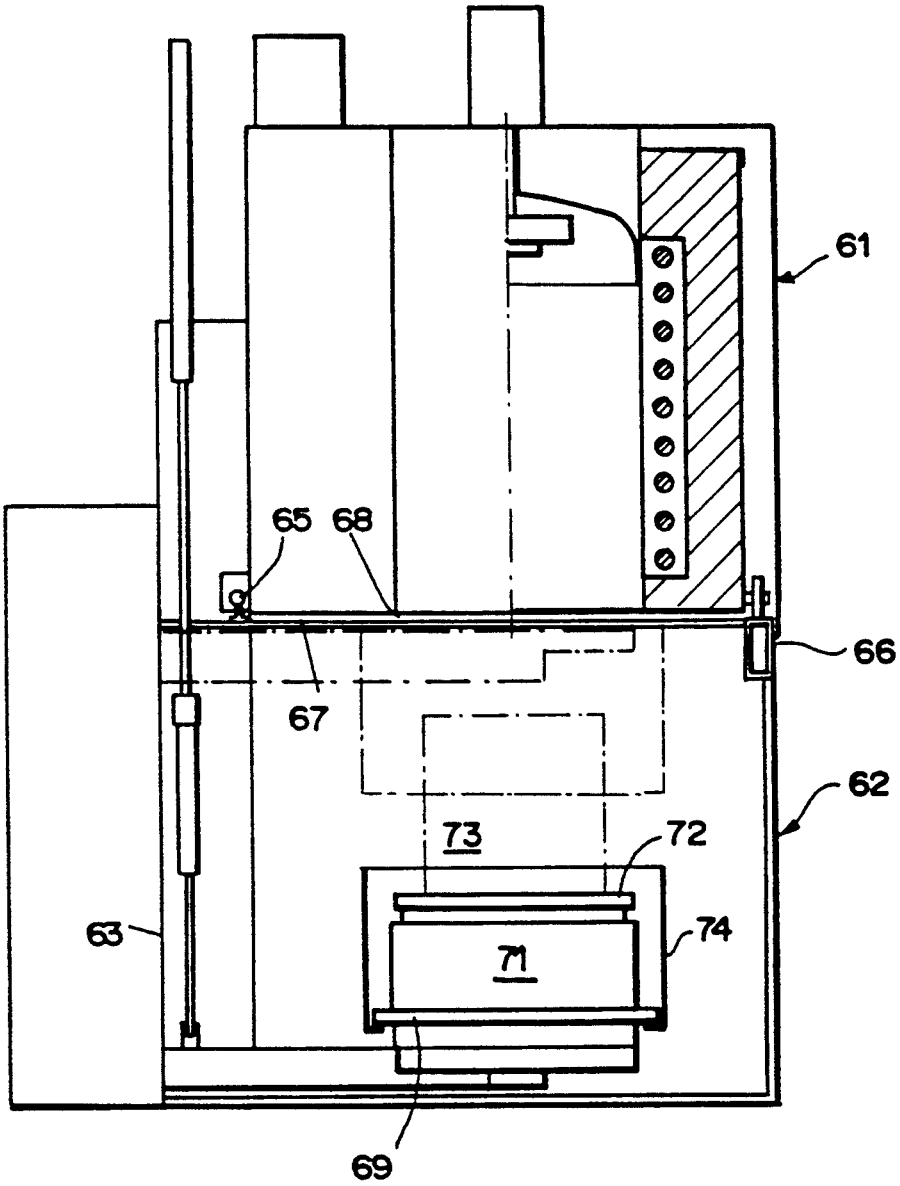
Figure 13:
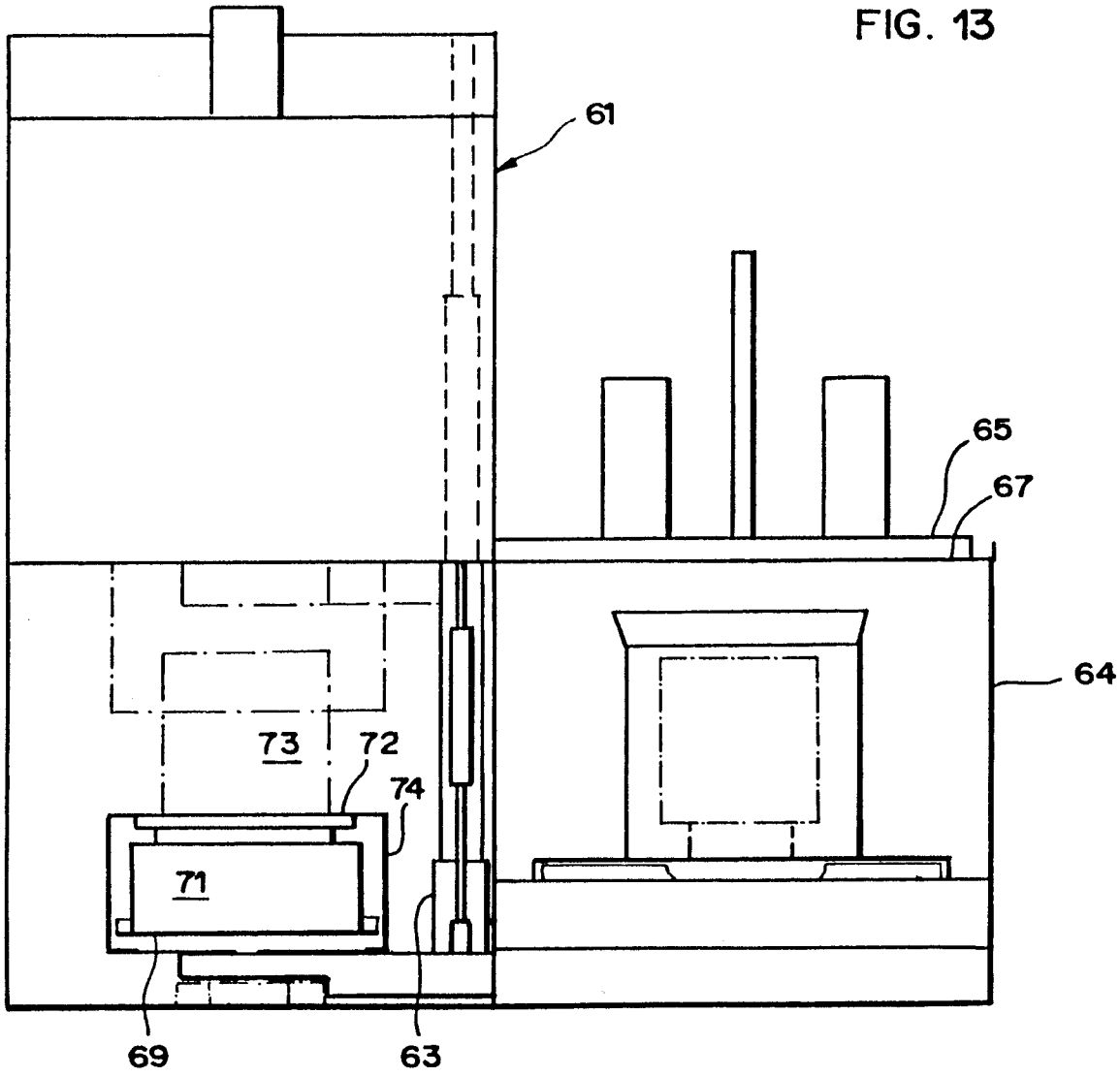

The improved embodiment shown in FIGS. 11, 12 and 13 is distinguished by different details.

A horizontally mobile furnace on a structure 62, a loading lift 63 and a vat 64 constitute the principle elements of this installation.

The furnace 61 can be displaced horizontally on two parallel rails 65 and 66 so as to pass from a position above the lift 63 to a position above the vat 64 and vice versa.

A horizontal platform 67, whose upper surface is flat, extends above the vat forming a cover, and below the place occupied by the furnace during loading. This platform comprises a circular opening 68 which is centred in relation to the platform 69 of the lift 63. The lift 63 carries a hydraulic piston (not shown) which allows the platform 69 and the plug 71 to be displaced in relation to the arm of the lift which is itself driven by a jack 78 and guided by a column 76. The grid 72 bearing the charge 73 is carried by the platform 69. A cylindrical basin-shaped jacket 74 surrounds the platform 69. It is mounted on the arm of the lift.

During a loading operation, the jack 78 is operated to raise the lift until the upper edge of the jacket 74 abuts against the lower surface of the cover 67. The grid is then positioned at the level of the sliding plane. The piston 70 is controlled so that the platform 69, the plug 71 and the batch 73 pass through the opening 68. The plug seals the lower opening of the furnace so that the temperature can be raised for the heat treatment of the parts (position shown by the dot-dash line in FIGS. 12 and 13). The upper edge of the jacket 74 then abuts against the cover 67. It ensures that the furnace 61 is tightly sealed even when the plug is not in its completely closed position. This seal allows the batch to be shifted over the sliding plane given by the ribs 68 without any risk that the parts will be oxidized, even though the plug is then in its intermediate position.

The jacket 74 can be made in different ways. It can comprise two telescoping parts or one single part, as shown in the drawing. It can be displaced by one or several jacks. The jacket can also be made of a flexible metallic material so its dimensions can undergo a change according to the position of the lift so as to tightly seal the opening 68 of the slide platform when the batch is shifted with the furnace to be slid onto the platform 75 (FIG. 11) of the vat lift.

It can be seen in the embodiment shown in FIGS. 11, 12 and 13, that the columns 76 and 77 as well as the jacks 78 and 79 controlling the lifts are devices grouped together closely at the back of the installation. The latter is very compact and is made up of a minimum number of elements.

The installations described above have a number of advantages in relation to the existing installations:

1. By means of only three motorized devices, all the transfer operations for all the treatments are ensured with all the necessary flexibility.

2. During the entire treatment, the batch is protected by the treatment atmosphere, whether in the furnace or in the vat.

3. The removable-cover furnace can be a high temperature furnace, and because its opening is situated at the bottom of the bell, the temperature and the circulation of the gases are homogenous.

4. The entire installation occupies a very small ground surface.

5. One and the same loading and unloading means, operated manually or possibly being motorized, allow the operation of several treatment units each made up of a furnace, a vat or two vats, and a loading lift, this latter capable of being mobile if need be.

6. The batch is borne by a platform throughout the entire operation and it is therefore not necessary to include a fixing means for a transfer operation suspended over the cooling vat.

7. The general design of the system is very simple whilst being flexible, which reduces the set-up costs.

8. The entire installation can easily be automated or computerized.

We claim:

1. An installation for the heat treatment of successive batches, comprising a vertically disposed furnace in an upper position having an open bottom, a vat equipped with a lift and placed in a lower position, a horizontal access track mounted at a level of a vat bottom and fitted with loading means for loading a batch onto the lift, and a loading lift disposed at a side of the vat to lift a batch loaded onto the lift by the loading means into the furnace, the furnace being horizontally mobile between a position above the loading lift and a position above the vat, wherein a level of the furnace bottom defines a sliding plane, and a batch supported by the loading lift is shifted along said plane by displacing said furnace.

2. The installation of claim 1, wherein the loading lift carries a plug capable of sealing the furnace, and wherein the plug has a flat surface for supporting the batch.

3. The installation of claim 2, wherein the batch comprises a base grid supporting the batch, and the furnace has a belt-shaped base that latterally pushes the grid along said sliding plane, the plug being in an intermediate position when the furnace is displaced from the position above the loading lift towards the position above the vat.

4. The installation of claim 3, wherein the vat is provided with a cover having an opening for a platform of the vat lift to pass through, and wherein the upper surface of the cover is at the level of said sliding plane.

5. The installation of claim 4, wherein the vat lift platform and the surface of the plug are at the level of said sliding plane when the plug is in its intermediate position, the base grid being slidingly displaced along said sliding plane when the base grid is pushed by the base of the furnace.

6. The installation of claim 5, wherein the vat cover, vat lift platform, and the surface of the plug comprise a gas-tight surface allowing the furnace to be sealed in a gas-right manner as the furnace is displaced.

7. The installation of claim 2, in which the loading means comprise loading and unloading cars, and wherein the cars are provided with platforms capable of limited vertical displacement, allowing a base grid of a batch to be transferred respectively from a platform of a loading car over the plug, or from the vat lift onto a platform of an unloading car.

8. The installation of claim 7, wherein the car platforms each have a semi-circular opening.

9. The installation of claim 7, wherein the car platforms are supported by an eccentric device allowing said limited displacement by means of the action of a lever.

10. The installation of claim 1, wherein the loading lift is fitted with a sealing device capable of preventing air from entering the furnace when said loading lift carries a batch to a level where a bottom surface of the batch is at time the level of the sliding plane.

11. An installation for the heat treatment of successive batches, comprising:

a vertically disposed furnace having an open bottom;

a vat positioned at a level lower than the furnace; and a support that lifts a batch through the open bottom into the furnace;

wherein the furnace is movable between a first position above the support and a second position above the vat; and wherein movement of the furnace from the first position toward the second position causes the furnace to move the batch off the support.

12. The installation of claim 11, wherein the support comprises a plug that seals the open bottom of the furnace when the support is in an elevated position.

13. The installation of claim 11, further comprising:

a vertically movable vat lift having an upper surface that lies in the same plane as an upper surface of the support during movement of the furnace from the first position toward the second position;

wherein during movement of the furnace from the first position toward the second position, the furnace moves the batch off the upper surface of the support onto the upper surface of the vat lift.

14. The installation of claim 13, further comprising:

a vat cover positioned over the vat, the vat cover having an opening in which the vat lift moves and having an upper surface that lies in the same plane as the upper surface of the support during movement of the furnace from the first position toward the second position.

15. The installation of claim 14, wherein the upper surface of the vat lift, the upper surface of the vat cover, and the upper surface of the support allow the furnace to be sealed as the furnace moves from the first position toward the second position.

* * * * *